US009700139B2

(12) United States Patent
Su

(10) Patent No.: US 9,700,139 B2
(45) Date of Patent: Jul. 11, 2017

(54) ARMREST STRUCTURE FOR A CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 37 days.

(21) Appl. No.: 14/816,010

(22) Filed: Aug. 2, 2015

(65) Prior Publication Data

US 2017/0027324 A1 Feb. 2, 2017

(51) Int. Cl.
*A47C 7/54* (2006.01)
*A47C 1/03* (2006.01)

(52) U.S. Cl.
CPC ..... *A47C 1/03* (2013.01)

(58) Field of Classification Search
CPC ..... A47C 1/03
USPC ..... 297/411.36
See application file for complete search history.

(56) References Cited

U.S. PATENT DOCUMENTS 6,336,680 B1 * 1/2002 Lee ..... A47C 1/03 297/411.36
7,066,546 B2 * 6/2006 Trego ..... A47C 1/03 297/411.36
7,448,687 B2 * 11/2008 Tsai ..... A47C 1/03 297/411.36 X
7,533,939 B2 * 5/2009 Fookes ..... A47C 1/03 297/411.36 X
7,556,316 B1 * 7/2009 Lai ..... A47C 1/03 297/411.36 X
9,173,498 B2 * 11/2015 Colasanti ..... A47C 1/03
2005/0146191 A1 * 7/2005 Machael ..... A47C 1/03 297/411.36
2007/0024100 A1 * 2/2007 Chan ..... A47C 1/03 297/411.36
2007/0164595 A1 * 7/2007 Chi ..... A47C 1/03 297/411.36
2008/0073965 A1 * 3/2008 Tsai ..... A47C 1/03 297/411.36
2008/0079302 A1 * 4/2008 Grove ..... A47C 1/03 297/411.36
2008/0191537 A1 * 8/2008 Oda ..... A47C 1/03 297/411.36
2008/0296955 A1 * 12/2008 Geister ..... A47C 1/03 297/411.36
2009/0096271 A1 * 4/2009 Tsai ..... A47C 1/03 297/411.36
2010/0038950 A1 * 2/2010 Lee ..... A47C 1/03 297/411.36

(Continued)

*Primary Examiner* — Rodney B White

(57) ABSTRACT

The armrest structure includes a connecting seat having a sleeve. A height adjustment rod is disposed in the sleeve and has two symmetric boards. Each of the boards is formed with recesses. A receiving room is formed between the two boards. An elevation rod is disposed in the sleeve. An end of the elevation rod has a projection received in the receiving room. Another end of the elevation rod has a connecting seat with a cylinder and a spring. An armrest set has a tube and an armrest connected atop the tube. The tube is received in the sleeve and sheathes the height adjustment rod and elevation rod. A top of the tube is formed with a channel for receiving a trigger. A fixing bar passes through the projection and is embedded into one of the recesses.

15 Claims, 11 Drawing Sheets

(56) References Cited

U.S. PATENT DOCUMENTS

| | | | | |
|---|---|---|---|---|
| 2010/0060065 | A1* | 3/2010 | Hung | A47C 7/407<br>297/411.36 X |
| 2011/0221251 | A1* | 9/2011 | Tsai | A47C 1/03<br>297/411.36 |
| 2011/0248543 | A1* | 10/2011 | Hitchcock | A47C 1/03<br>297/411.36 |
| 2012/0098318 | A1* | 4/2012 | Chen | A47C 1/03<br>297/411.36 |
| 2012/0104823 | A1* | 5/2012 | Lai | A47C 1/03<br>297/411.36 |
| 2012/0205958 | A1* | 8/2012 | Colasanti | A47C 7/54<br>297/411.36 |
| 2013/0320739 | A1* | 12/2013 | Chen | A47C 7/54<br>297/411.36 |
| 2014/0183922 | A1* | 7/2014 | Cvek | A47C 1/03<br>297/411.36 |

* cited by examiner

ARMREST STRUCTURE FOR A CHAIR

BACKGROUND OF THE INVENTION

1. Technical Field

The invention relates to chairs, particularly to armrests of chairs.

2. Related Art

Office chairs with an elevation mechanism and/or flexible back have been very popular. However, armrests of few chairs provide an adjustment mechanism. Even if an adjustment mechanism is provided to armrests of a chair, its height adjustment function is so simple, i.e., it only allows the highest and lowest positions. Although some armrest adjustment mechanisms use a more complicated structure to enhance adjustability, their reliability is not good enough. Complexity, adjustability and reliability are very difficult to achieve a compromise.

SUMMARY OF THE INVENTION

An object of the invention is to provide an armrest structure for a chair, which offers a vertical and horizontal adjustment function.

To accomplish the above object, the armrest structure of the invention includes a connecting seat having a sleeve. A height adjustment rod is disposed in the sleeve and has two symmetric boards. Each of the boards is formed with recesses. A receiving room is formed between the two boards. An elevation rod is disposed in the sleeve. An end of the elevation rod has a projection received in the receiving room. Another end of the elevation rod has a connecting seat with a cylinder and a spring. An armrest set has a tube and an armrest connected atop the tube. The tube is received in the sleeve and sheathes the height adjustment rod and elevation rod. A top of the tube is formed with a channel for receiving a trigger. A fixing bar passes through the projection and is embedded into one of the recesses.

DETAILED DESCRIPTION OF THE INVENTION

Figure 1:
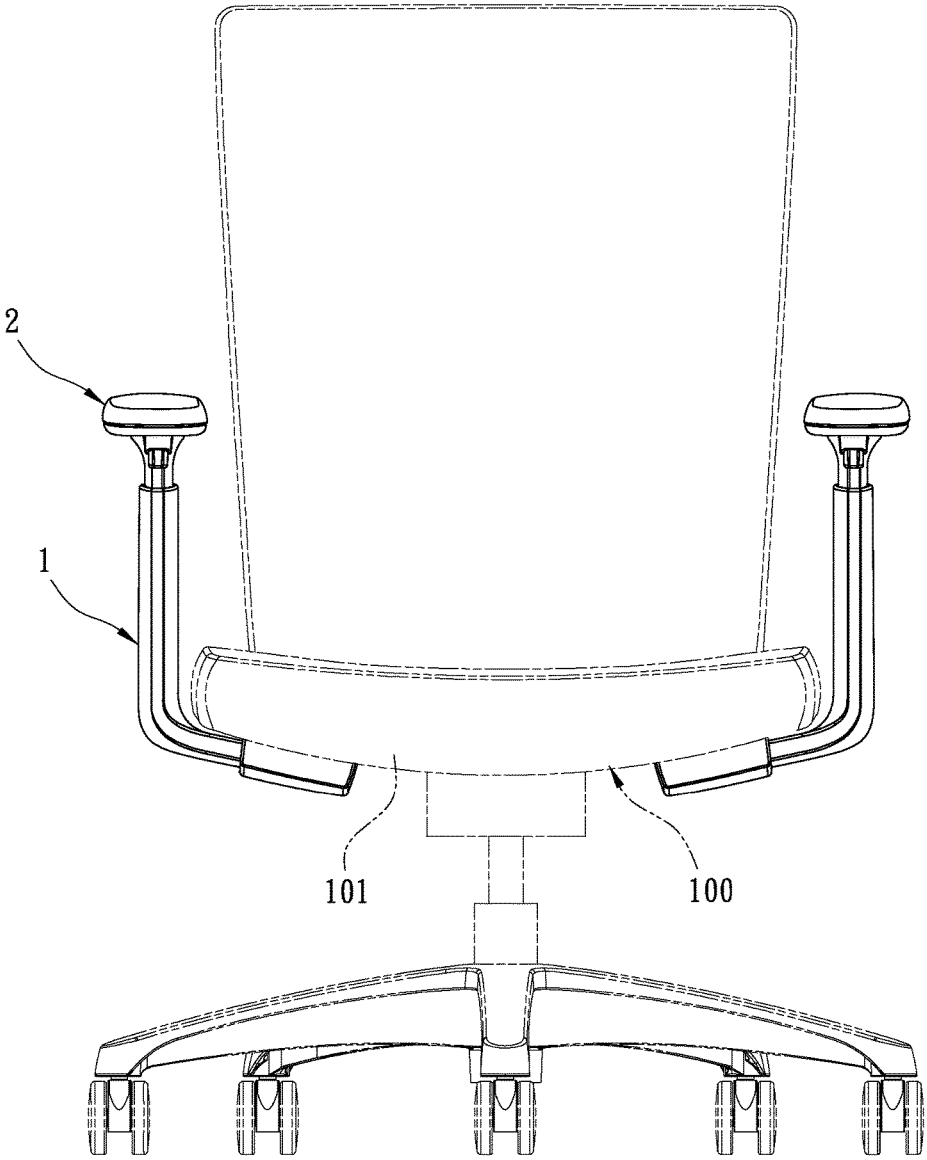
FIG. 1 is a schematic view of the invention.
Figure 2:
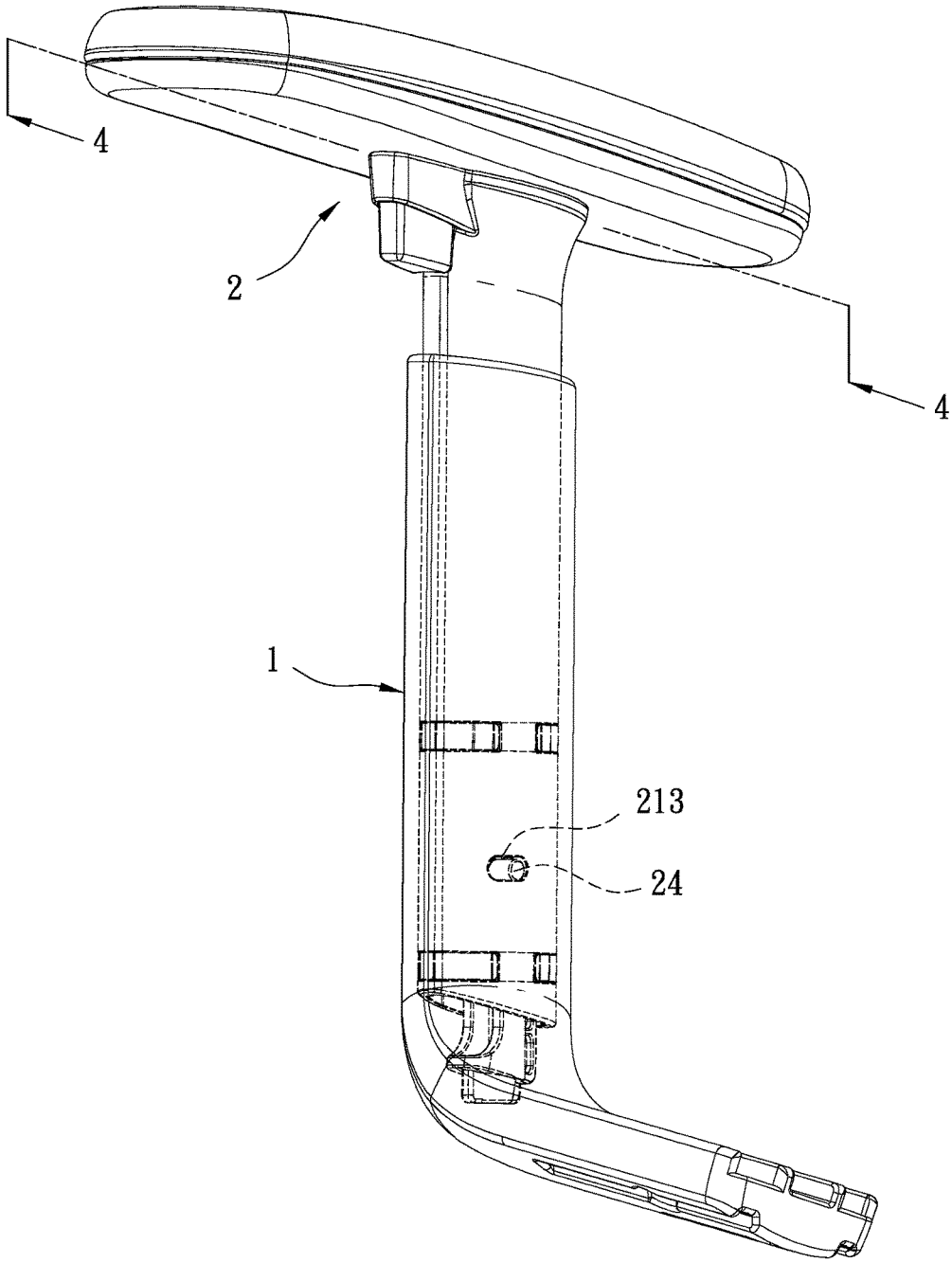
FIG. 2 is a perspective view of the invention.

Please refer to FIG. 1. A pair of the armrest structures of the invention is separately and symmetrically installed beside a chair 100. As shown in FIG. 2, the armrest structure of the invention includes a connecting seat 1 and an armrest set 2. The connecting seat 1 is fastened to the bottom of a cushion 101 of the chair 100. The connecting seat 1 is of an L-shape and has a sleeve 12 and a connecting rod 11. In this embodiment, the sleeve 12 is integrated with the connecting rod 11. The connecting rod 11 is formed with trenches 111 for connecting with the cushion 101. The bottom of the sleeve 12 is formed with a cavity 121 as shown in FIG. 4.

Figure 3:
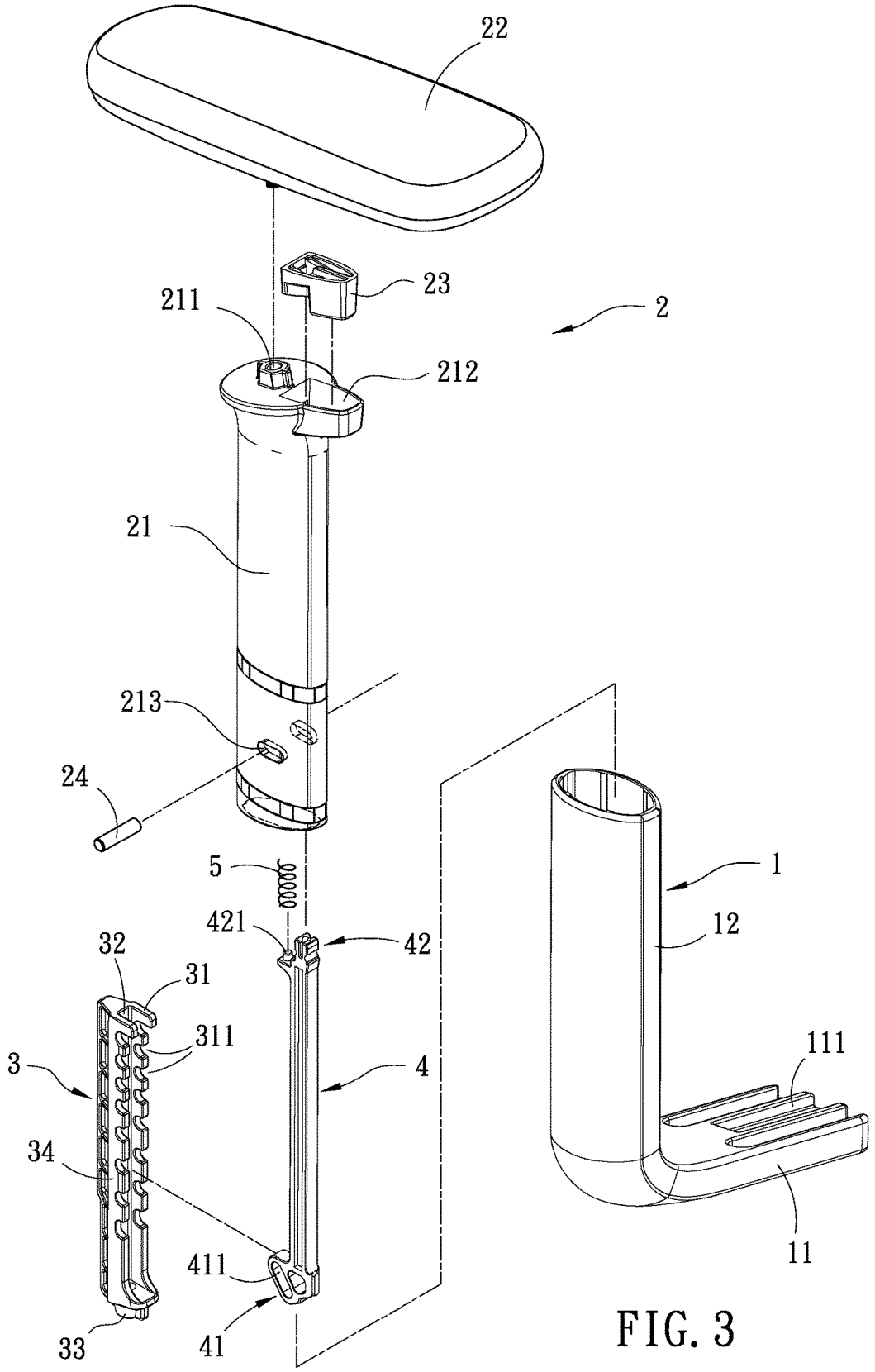
FIG. 3 is an exploded view of the invention.

Please refer to FIG. 3. A height adjustment rod 3 is disposed in the sleeve 12. The height adjustment rod 3 has two symmetric parallel boards 31. Each of the two boards 31 is formed with semicircular recesses 311. The recesses 311 on the two boards 31 are arranged in pairs. A receiving room 32 is formed between the two boards 31 and is longitudinal. The bottom of the height adjustment rod 3 is formed an insert 33 received in the cavity 121 so that the height adjustment rod 3 is secured in the sleeve 12. Additionally, the height adjustment rod 3 has an attaching portion 34 for abutting against the sleeve 12 to keep the height adjustment rod 3 vertical. An elevation rod 4 is disposed in the sleeve 12 and is parallel to the height adjustment rod 3. An end of the elevation rod 4 has a projection 41 received in the receiving room 32. The projection 41 is formed with an inserting hole 411. Another end of the elevation rod 4 has a connecting seat 42 with a cylinder 421 and a spring 5 secured around by the cylinder 421.

Please refer to FIG. 3. The armrest set 2 includes a tube 21 and an armrest 22 connected atop the tube 21. In this embodiment, the armrest set 2 is of a T-shape. The tube 21 is axially received in the sleeve 12 and sheathes the height adjustment rod 3 and elevation rod 4. A top of the tube 21 is formed with a protruding block 211 engaging with the bottom of the armrest 22 and a channel 212 communicating with an inside of the tube 21. A trigger 23 is received in the channel 212 and the bottom of the trigger 23 is received in the tube 21. The trigger 23 connects with the connecting seat 42, and the spring 5 pushes a top end of the sleeve 21 as shown in FIG. 4. The other end of the tube 21 is provided with a through hole 213 for being passed through by a fixing bar 24. The through hole 213 corresponds to the projection 41 of the elevation rod 4 in position so that the fixing bar 24 can be inserted into the inserting hole 411 and embedded into one of the recesses 311.

Figure 4:
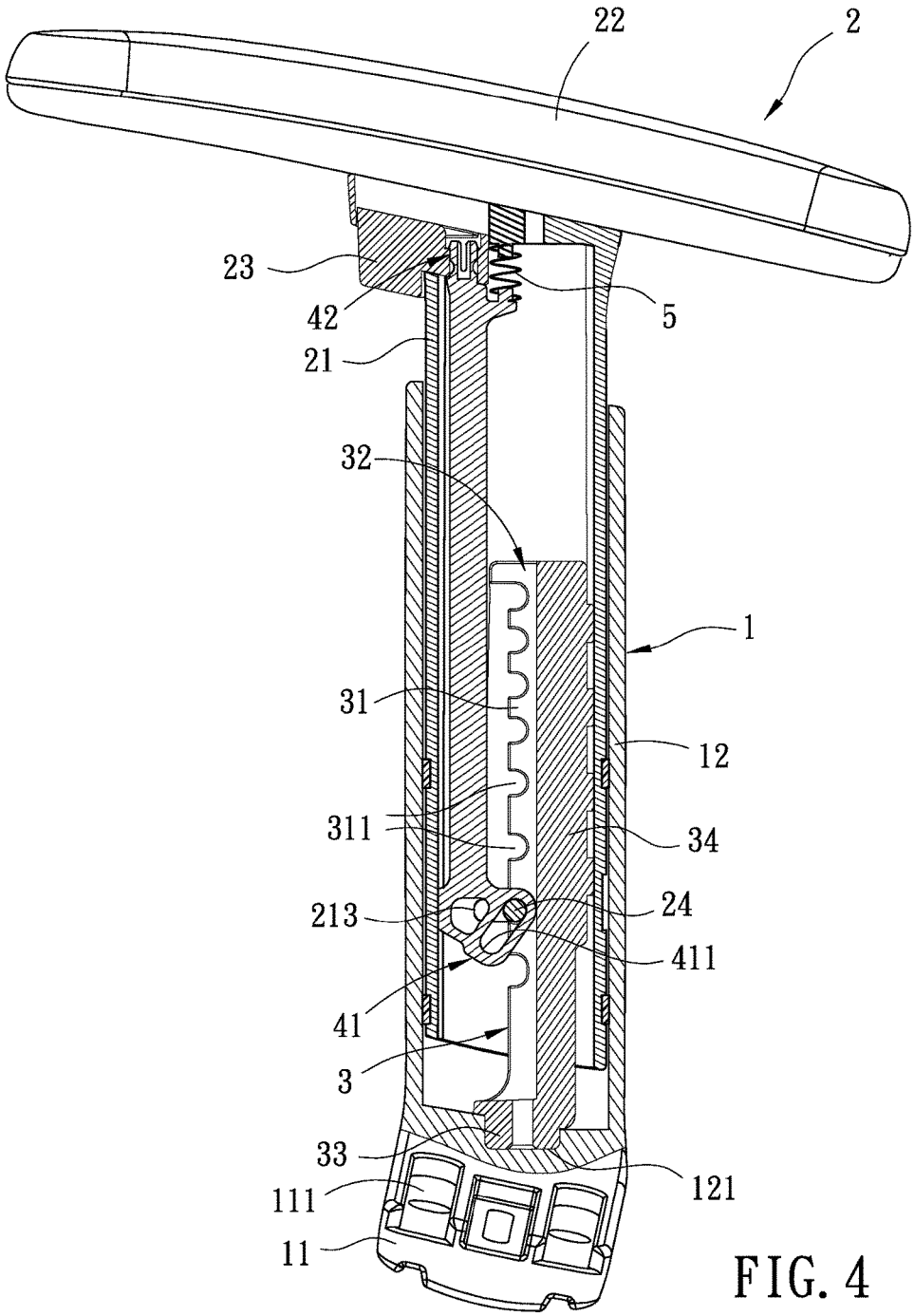
FIGS. 4-7 are cross-sectional views of the invention in four statuses of operation.
Figure 5:
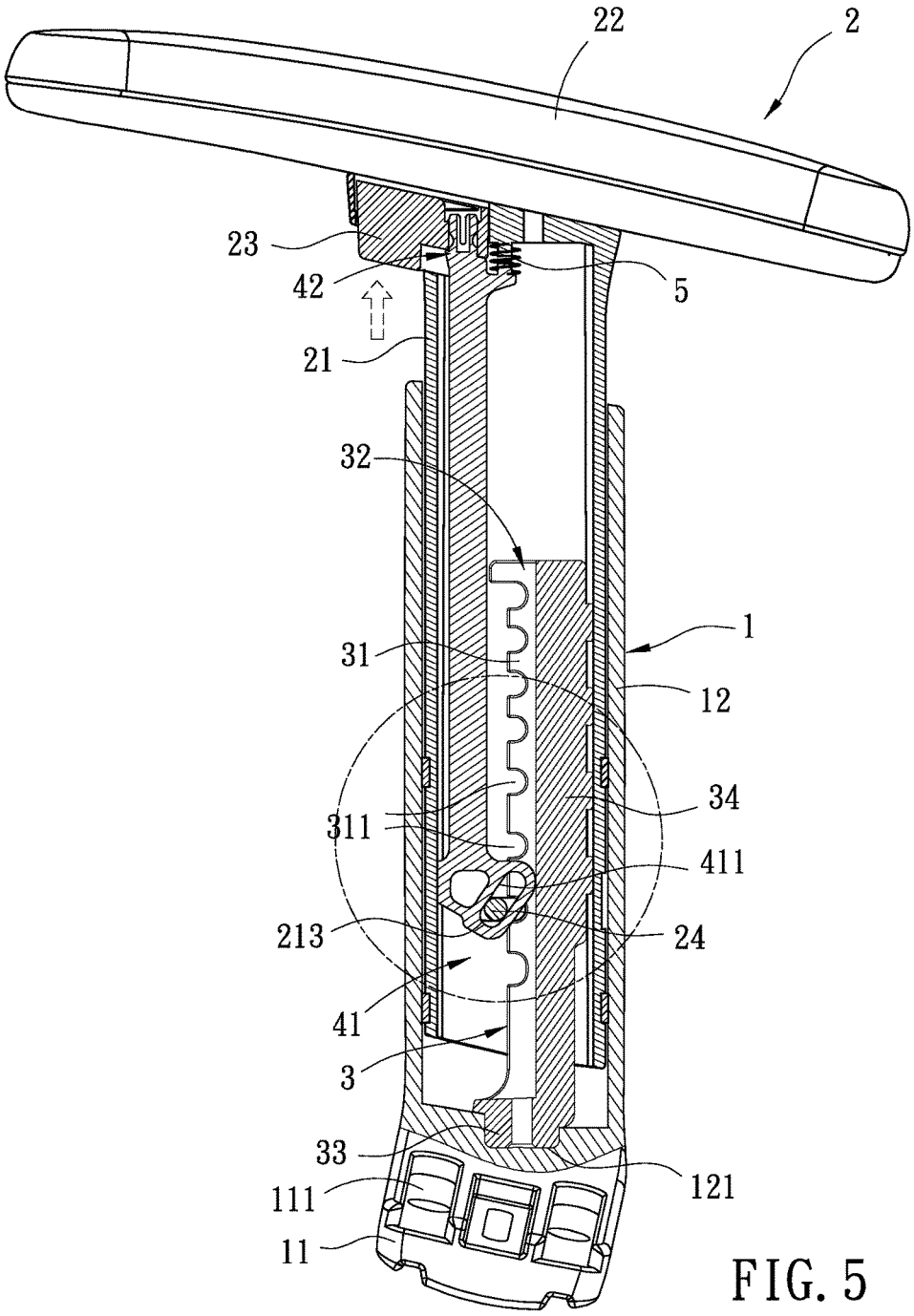
Figure 6:
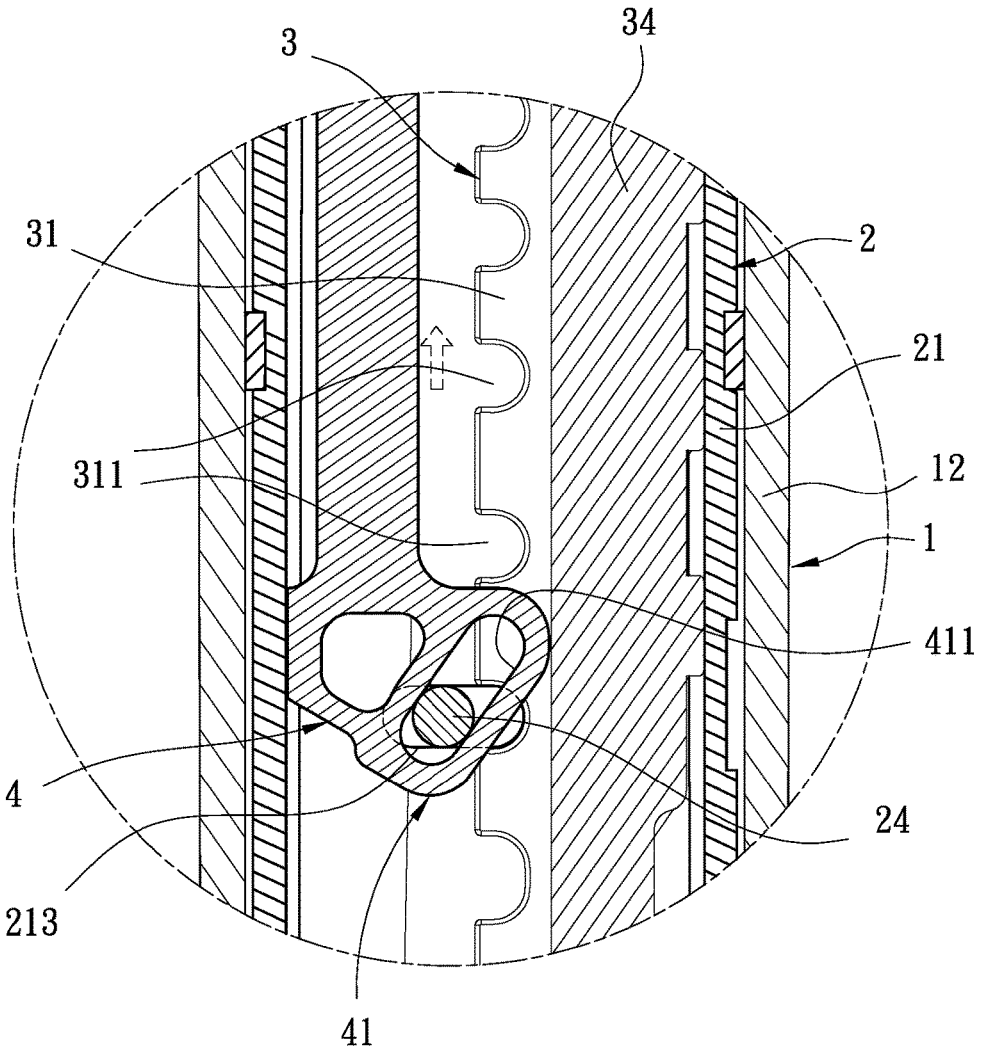
Figure 7:
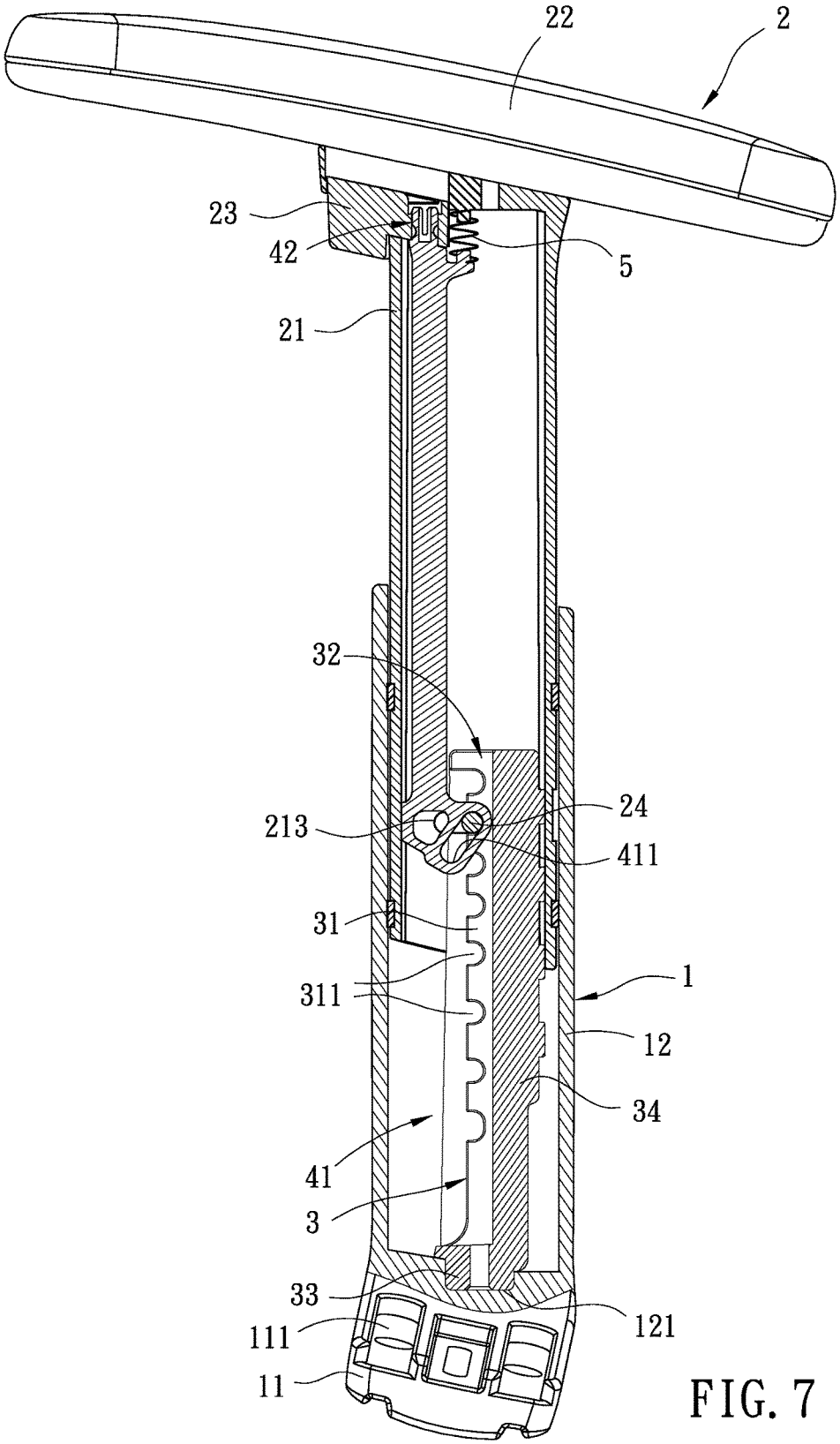

Please refer to FIGS. 4-7. FIG. 4 shows an original status of the invention. The height adjustment rod 3 and elevation rod 4 are received in the connecting seat 1 and the armrest set 2. A relative position and overall length of the height adjustment rod 3 and elevation rod 4 can be changed by varying the fixing bar 24 to be embedded into different recesses 311. When the height of the armrest 22 needs to be adjusted, as shown in FIG. 5, press the trigger 23 to elevate the elevation rod 4 and to make the spring 5 press the inside of the tube 21. At this time, the projection 41 is deformed when it is being moved and the angle of the inserting hole 411 is also changed, so that the fixing bar 24 escapes from the recess 311 to drop to another side of the inserting hole 411 and the elevation rod 4 become movable because it is not limited by the fixing bar 24 temporarily as shown in FIG. 6. As shown in FIG. 7, when the elevation rod 4 has been moved to a desired position, the fixing bar 24 drops to another one of the recesses 311 and the spring 5 pushes down the elevation rod 4 to make the height adjustment rod 3 and elevation rod 4 positioned by the fixing bar 24. Meanwhile, the trigger 23 automatically restores to finish the process of armrest height adjustment.

Figure 8:
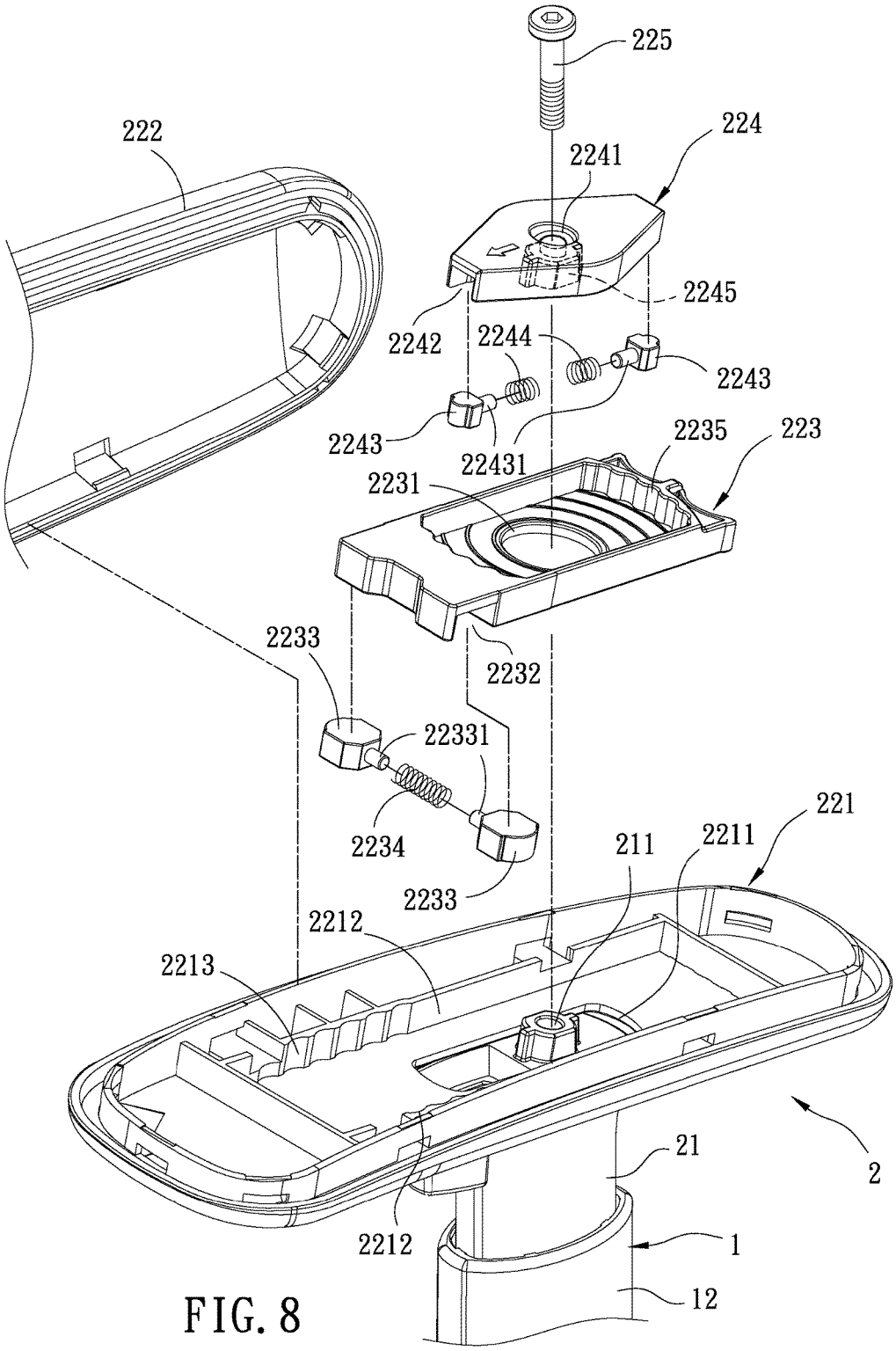
FIG. 8 is an exploded view of the armrest set of the invention.
Figure 9:
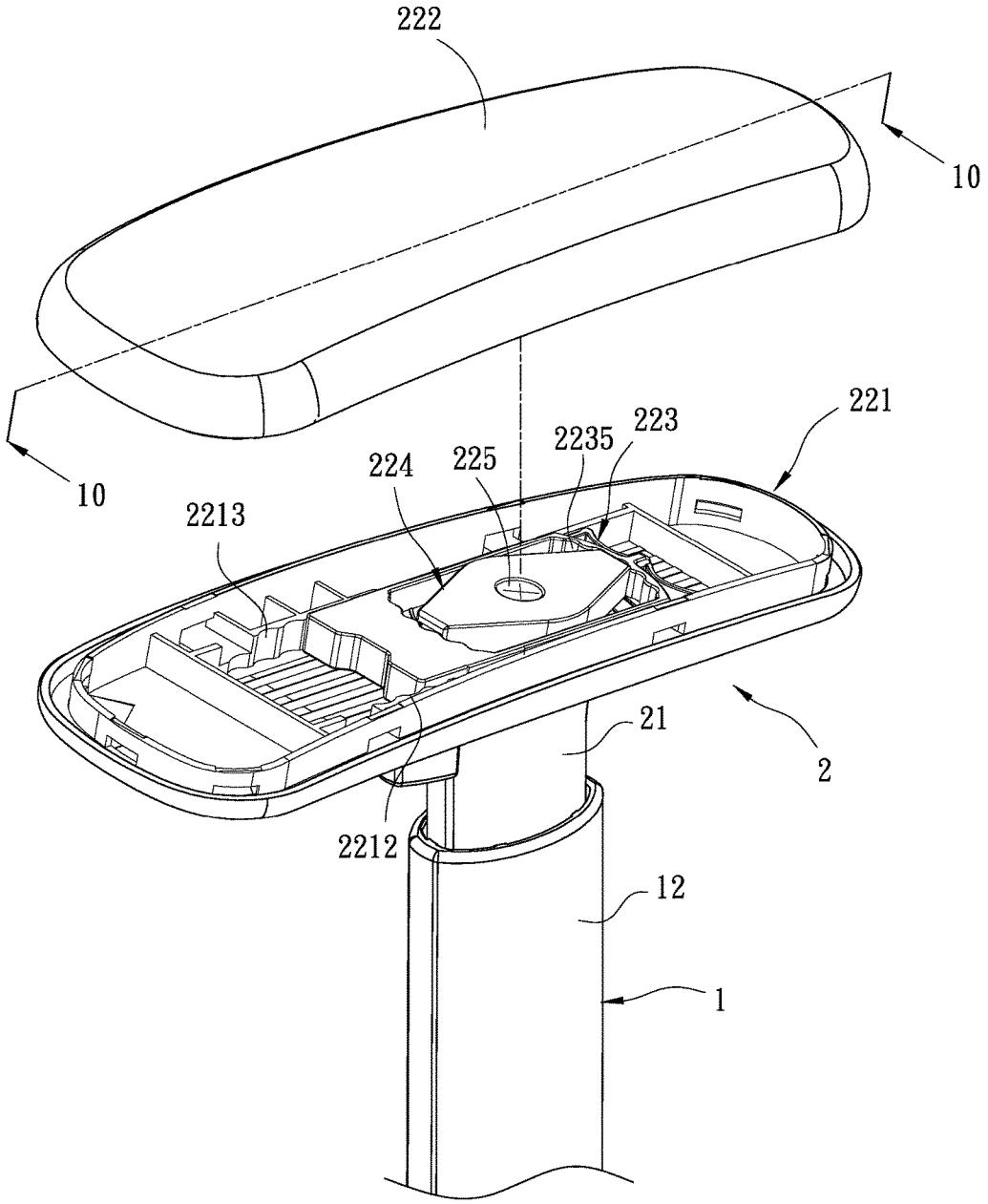
FIG. 9 is a perspective view of the invention.

Please refer to FIG. 8. The armrest 22 includes a base 221 and a cover 222. The base 221 is formed with an opening 2211. In this embodiment, the opening 2211 is square. The protruding block 211 is received in the opening 2211. The base 221 is formed with two parallel guide boards 2212. One side of each guide board 2212 is formed with a wavy surface 2213. The wavy surfaces 2213 on the two guide boards 2212 correspond to each other in position. The base 221 is provided with a rotation seat 223 with a passing hole 2231 which is round in shape. The rotation seat 223 is received in the base 221 and corresponds to the opening 2211 in position so that the protruding block 211 can be received in the passing hole 2231. An end of the rotation seat 223 is formed with two troughs 2232 in a row. Each trough 2232 receives a guide block 2233 with a protruding bar 22331. The two protruding bars 22331 align each other and jointly pass through a spring 2234. The guide blocks 2233 correspond to the wavy surfaces 2213. Each of two opposite inner ends of the rotation seat 223 is formed with a guide surface 2235. The guide surfaces 2235 correspond to each other and are wavy in shape. A steering seat 224 is disposed in the rotation seat 223. The steering seat 224 is of a rhombic shape. The center of the rotation seat 224 is provided with a lock hole 2241 corresponding to the passing hole 2231 and opening 2211 in position. The lock hole 2241, passing hole 2231 and opening 2211 are passed by a screw 225 which screws with the protruding block 211. Additionally, each of two opposite ends of the rotation seat 224 is formed with a notch 2242 for receiving a steering block 2243. The steering blocks 2243 correspond to and abut against the guide surfaces 2235. Each steering block 2243 has a protruding bar 22431 which passes a spring 2244. The center of the rotation seat 224 is provided with a fixing seat 2245 by which the springs 2244 are stopped as shown in FIG. 9.

Figure 10:
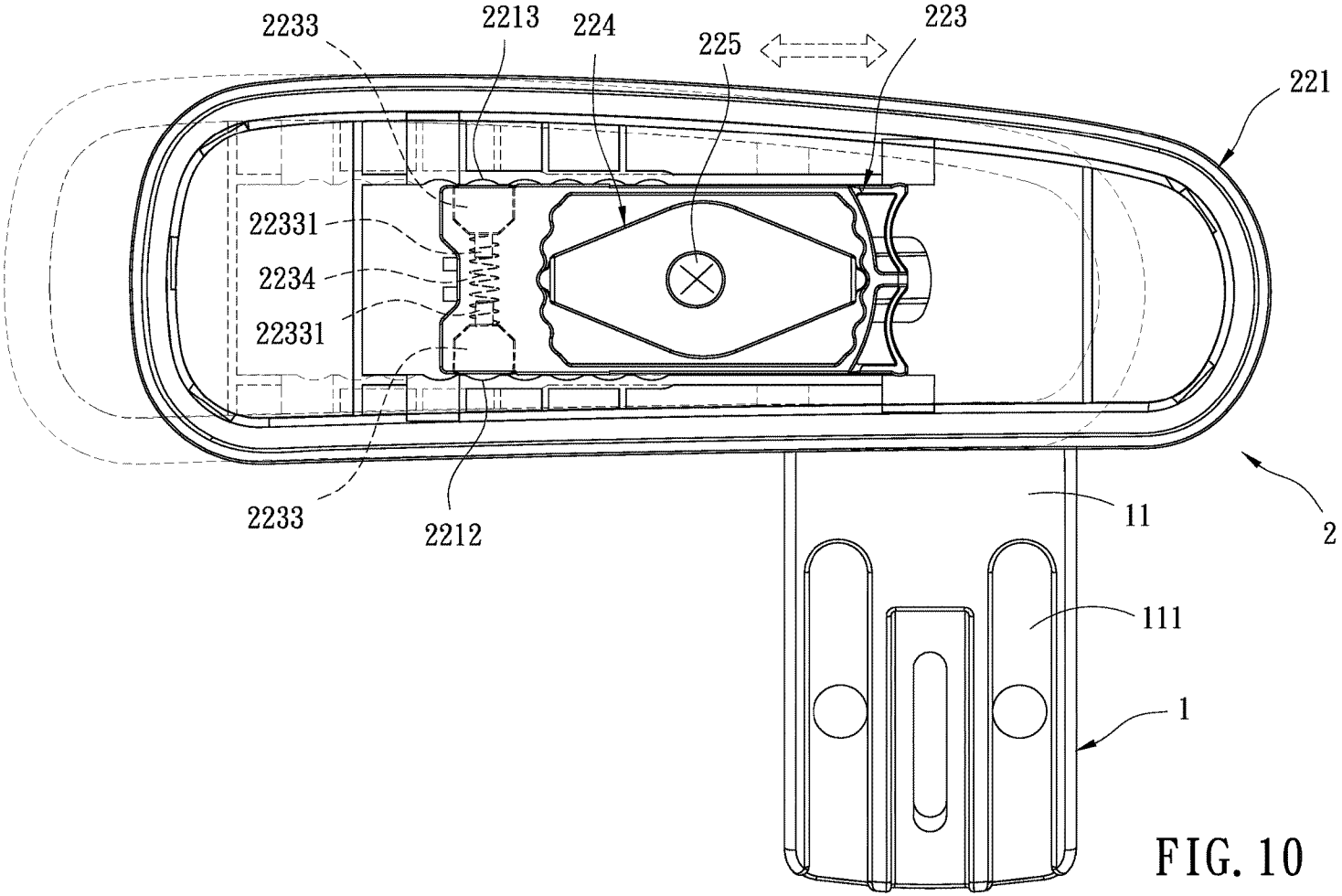
FIG. 10 is a schematic view of the armrest set of the invention.

Please refer to FIG. 10. When the armrest 22 needs to be longitudinally moved, because the guide blocks correspond to the wavy surfaces 2213, the springs 2234 around the guide blocks 2233 will push the guide blocks 2233 to restore by the guiding effect from the wavy surfaces 2213. Thus pressure forms between the guide blocks 2233 and the wavy surfaces 2213 to position longitudinally moving.

Figure 11:
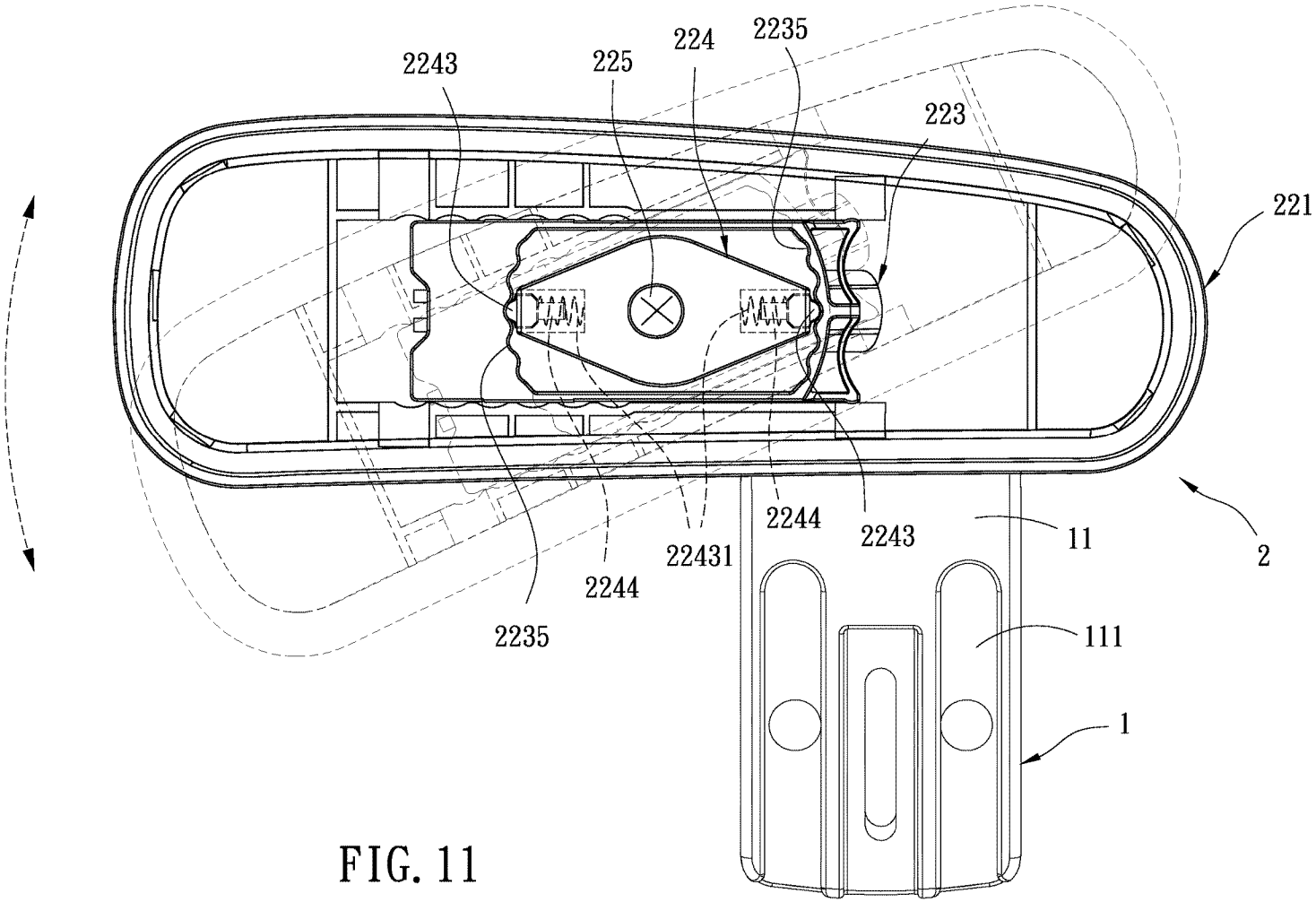
FIG. 11 is another schematic view of the armrest set of the invention.

Please refer to FIG. 11. When the armrest 22 needs to be horizontally rotated, the steering blocks 2243 of the steering seat 224 rotate along the guide surfaces 2235 to change and position the angle of the armrest 22.

It will be appreciated by persons skilled in the art that the above embodiment has been described by way of example only and not in any limitative sense, and that various alterations and modifications are possible without departure from the scope of the invention as defined by the appended claims.

What is claimed is:

1. An armrest structure for a chair, comprising:

a connecting seat, having a sleeve, a bottom of the sleeve being formed with a cavity;

a height adjustment rod disposed in the sleeve, being a U-shaped body having two parallel symmetric boards, each of the two boards being formed with semicircular recesses, a receiving room being formed between the two boards, and bottoms of the two boards being formed with an insert received in the cavity;

an elevation rod disposed in the sleeve, being out of and parallel to the height adjustment rod, a first end of the elevation rod being formed with a projection received in the receiving room, the projection having an inserting hole, a second end of the elevation rod being formed with a connecting seat with a cylinder and a spring secured around the cylinder;

an armrest set having a tube and an armrest connected atop the tube, the tube being received in the sleeve and sheathing the height adjustment rod and the elevation rod, a top of the tube being formed with a channel communicating with an inside of the tube, a trigger being received in the channel and connecting with the connecting seat, and the spring pushing a top end of the sleeve; and a fixing bar being inserted into the inserting hole and embedded into one of the recesses;

wherein a top of the tube is formed with a protruding block engaging with a bottom of the armrest, and the armrest set further comprises:

a base being formed with two parallel guide boards and an opening for receiving the protruding block, and one side of each guide board is formed with a wavy surface;

a rotation seat disposed in the base, having a passing hole corresponding to the opening so that the protruding block is received in the passing hole, an end of the rotation seat being formed with two troughs in a row, each trough receiving a guide block, and each of two opposite inner ends of the rotation seat being formed with a guide surface;

a steering seat being disposed in the rotation seat, a center of the rotation seat being provided with a lock hole corresponding to the passing hole and the opening, the lock hole, the passing hole and the opening being passed by a screw which screws with the protruding block, each of two opposite ends of the rotation seat being formed with a notch for receiving a steering block, and the steering blocks corresponding to and abutting against the guide surfaces; and a cover assembled with the base.

2. The armrest structure of claim 1, wherein the connecting seat further comprises a connecting rod.

3. The armrest structure of claim 2, wherein the sleeve is integrated with the connecting rod.

4. The armrest structure of claim 2, wherein the connecting rod is formed with trenches.

5. The armrest structure of claim 1, wherein the receiving room is longitudinal.

6. The armrest structure of claim 1, wherein the height adjustment rod has an attaching portion for abutting against the sleeve.

7. The armrest structure of claim 1, wherein the armrest set is of a T-shape.

8. The armrest structure of claim 1, wherein another end of the tube is provided with a through hole for being passed through by the fixing bar.

9. The armrest structure of claim 1, wherein the opening is square in shape.

10. The armrest structure of claim 1, wherein the passing hole is round in shape.

11. The armrest structure of claim 1, wherein each of the guide blocks is provided with a protruding bar, and the two protruding bars align each other and jointly pass through a spring.

12. The armrest structure of claim 1, wherein the guide surfaces correspond to each other and are wavy in shape.

13. The armrest structure of claim 1, wherein the steering seat is of a rhombic shape.

14. The armrest structure of claim 1, wherein each steering block has a protruding bar which passes through a spring.

15. The armrest structure of claim 14, wherein a center of the rotation seat is provided with a fixing seat by which the springs secured around by the protruding bars are stopped.

* * * * *